United States Patent [19]

Wood

[11] Patent Number: 4,881,483

[45] Date of Patent: Nov. 21, 1989

[54] BOAT ANCHOR

[76] Inventor: J. B. Wood, 1503 E. Edgewood La., Sapulpa, Okla. 74066

[21] Appl. No.: 303,313

[22] Filed: Jan. 30, 1989

[51] Int. Cl.[4] ..... B63B 21/24

[52] U.S. Cl. ..... 114/294

[58] Field of Search ..... 114/294–311

[56] References Cited

U.S. PATENT DOCUMENTS 3,485,199 12/1969 Schuman ..... 114/305

4,602,588 7/1986 MacLean ..... 114/301

FOREIGN PATENT DOCUMENTS 2156755 10/1985 United Kingdom ..... 114/303

*Primary Examiner*—Joseph F. Peters, Jr.

*Assistant Examiner*—Jesus D. Sotelo

*Attorney, Agent, or Firm*—Head & Johnson

[57] ABSTRACT

A boat anchor in the form of an enclosed housing defining two opposed internal walls, a flexible cable, such as a rope, secured at one end of the housing by which the anchor may be attached to a boat, an outwardly extending flange portion at the other end of the housing, a plurality of generally flat weight members received in a housing and a compression spring between the weight members urging them against the housing opposed internal walls whereby the weight of the anchor may be easily varied by varying the number of flat weight members.

8 Claims, 3 Drawing Sheets

BOAT ANCHOR

SUMMARY OF THE INVENTION

Recreational boat owners and particularly fishermen, typically carry an anchor. The anchor is preferably of the minimum weight which will serve to hold a boat against movement caused by wind or waves. The reason a minimum weight is desirable is that the anchor must be handled by a boat user and a very heavy anchor can be difficult to manage by an operator leaning over the side of a boat. Therefore, it is important that a weight anchor be sized accurately for the boat with which it is to be used. If the anchor is too light, it will not hold the boat against normally experienced wind and waves. If the anchor is too heavy, it is burdensome to use and represents an unnecessary weight which must be carried constantly in the boat.

In addition to the need of variable weights, the most desirable boat anchor must have other characteristics. It must be formed of material which does not rust and deteriorate in the presence of water. It preferably is formed of material which does not scratch or mar internal boat surfaces, and most particularly the desirable boat anchor must be configured so that it does not become irretrievably lodged under rocks, under sunken logs, in brush and so forth.

The present anchor fulfills the needs of the optimum boat anchor. It is formed of an enclosed housing which is achieved by two substantially identical portions which are bolted together. The housing provides an internal cavity and an opening in the top end. The opening is dimensioned to receive a rope. By means of a knot tied in the rope and a washer, the anchor is secured to one end of the rope, the other end of which may be secured to a boat so as to anchor the boat against drift caused by wind or waves.

The cavity within the anchor housing has opposed sidewalls which are preferably rectangular and the cavity receives a plurality of flat rectangular weights which may be made of lead or some heavy material which preferably is not subject to rust. The weights are positioned within the housing cavity and in engagement with the opposed internal side walls. A compression spring is positioned between the weights forcing them outwardly into engagement with the sidewalls, and thereby maintaining the weights in position within the housing. The number of weights may be adjusted to fit the weight of the anchor to the boat with which it is to be used. When the anchor is to be used with a larger boat, the number of weights can be added as necessary so that the weight of the anchor is sufficient to keep the boat from drifting in normal wind and waves. When the anchor is to be used with a smaller boat, the number of weights can be reduced so that the anchor is not unnecessarily heavy for use in the smaller boat.

The housing includes an outwardly and downwardly extending flange portion around the lower end thereof. The flange portion serves to cause a drag when the anchor is on the bottom of a body of water to resist movement of the boat to which the anchor rope is attached. In addition, the flange serves to maintain the anchor in an upright position when resting on a surface within the boat when the anchor is not in use.

The downwardly extending flange portion serves to resist the pull of the anchor on the bottom surface of a body of water, but is upwardly tapered so that the anchor is not easily lodged under a rock, under a submerged tree or pipe, or in brush. The entire external surface of the anchor is configured to reduce to a minimum the possibility of the anchor being caught or hung on any submerged object.

Others have suggested boat anchors for recreational type boats and for background information relating to boat anchors, reference may be had to the following U.S. Pat. Nos.: 1,613,107; 2,239,889; 2,552,191; 3,158,127; 3,402,689; 4,602,588.

A better understanding of the invention will be had by reference to the following description and claims taken in conjunction with the attached drawings.

DESCRIPTION OF THE PREFERRED EMBODIMENT

Figure 4:
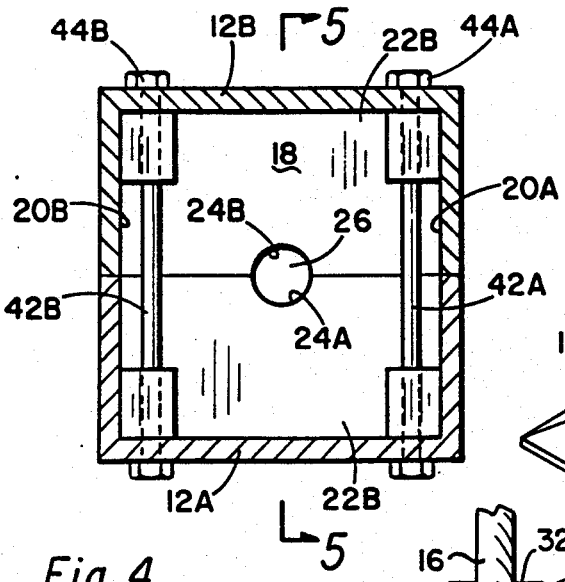
FIG. 4 is a cross-sectional view of the assembled boat anchor taken along the line 4—4 of FIG. 3.
Figure 1:
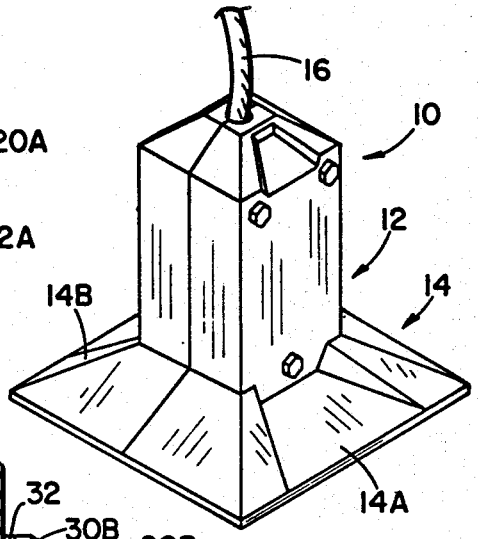
FIG. 1 is an isometric external view of a boat anchor of this invention.
Figure 3:
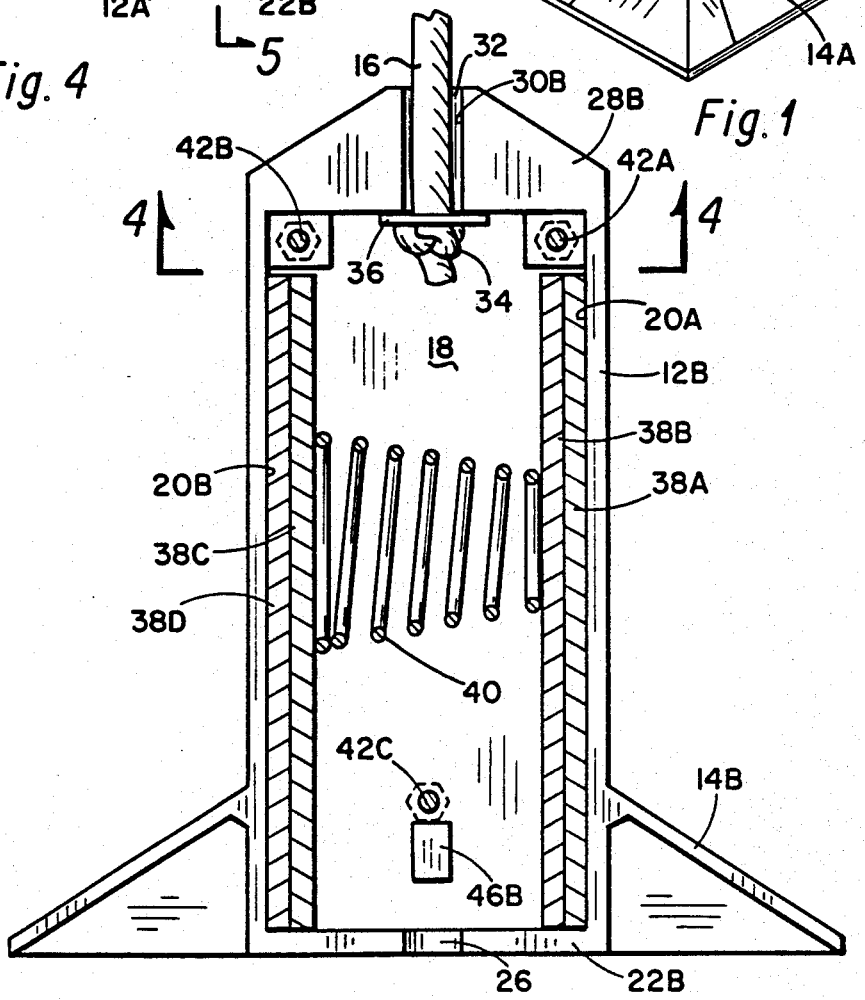
FIG. 3 is an elevational cross-sectional view of the boat anchor in assembled condition.
Figure 2:
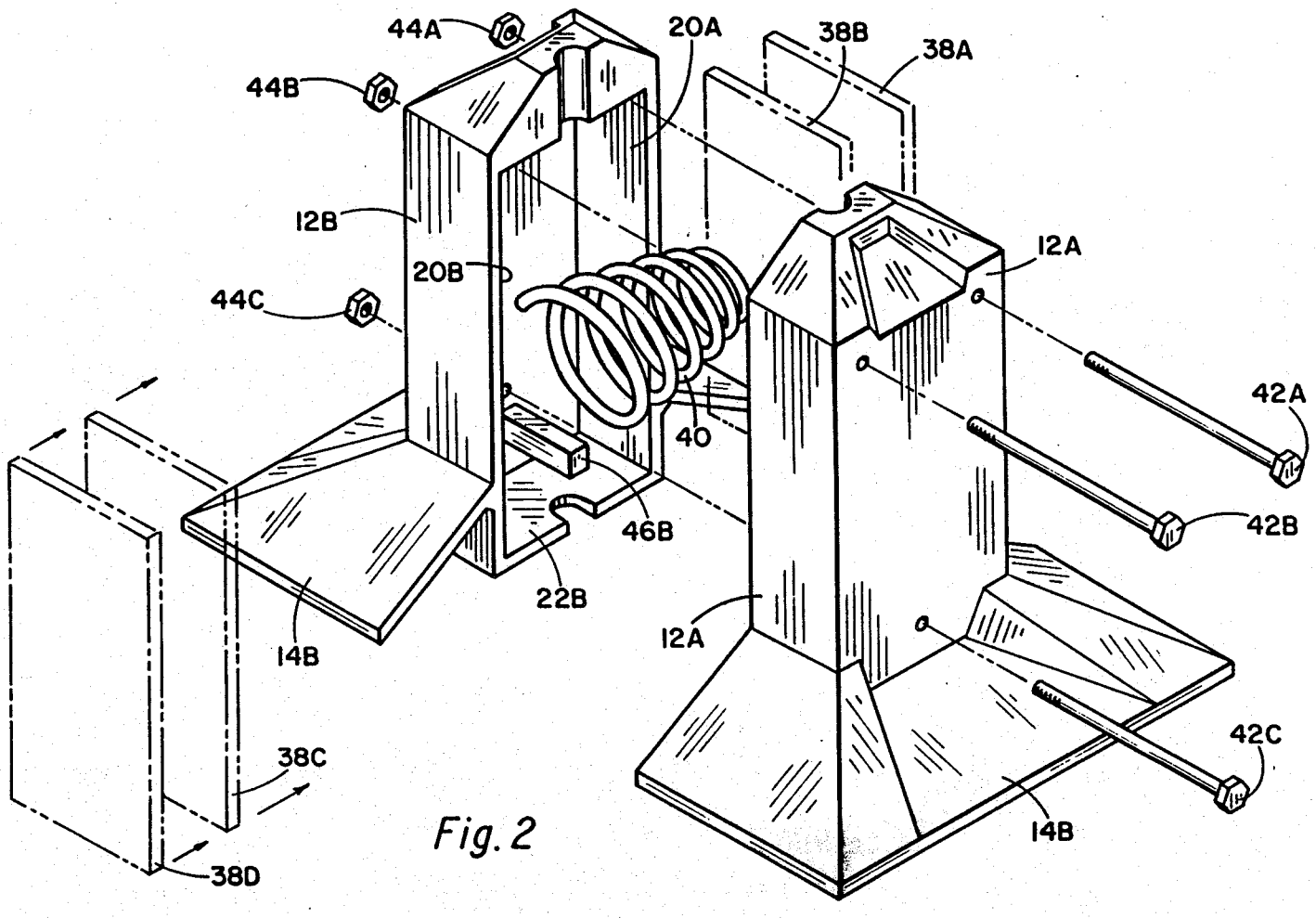
FIG. 2 is an enlarged exploded view of the boat anchor of FIG. 1 showing the components thereof in disassembly.
Figure 6:
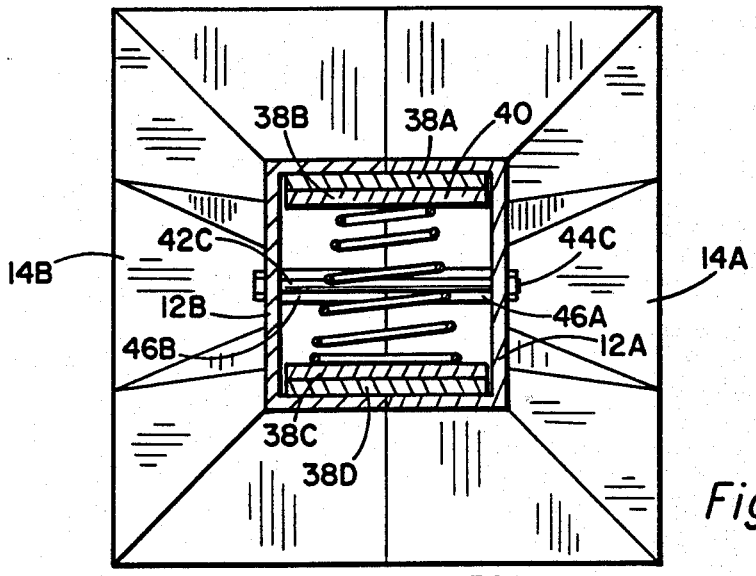
FIG. 6 is a cross-sectional view taken along the line 6—6 of FIG. 5.
Figure 5:
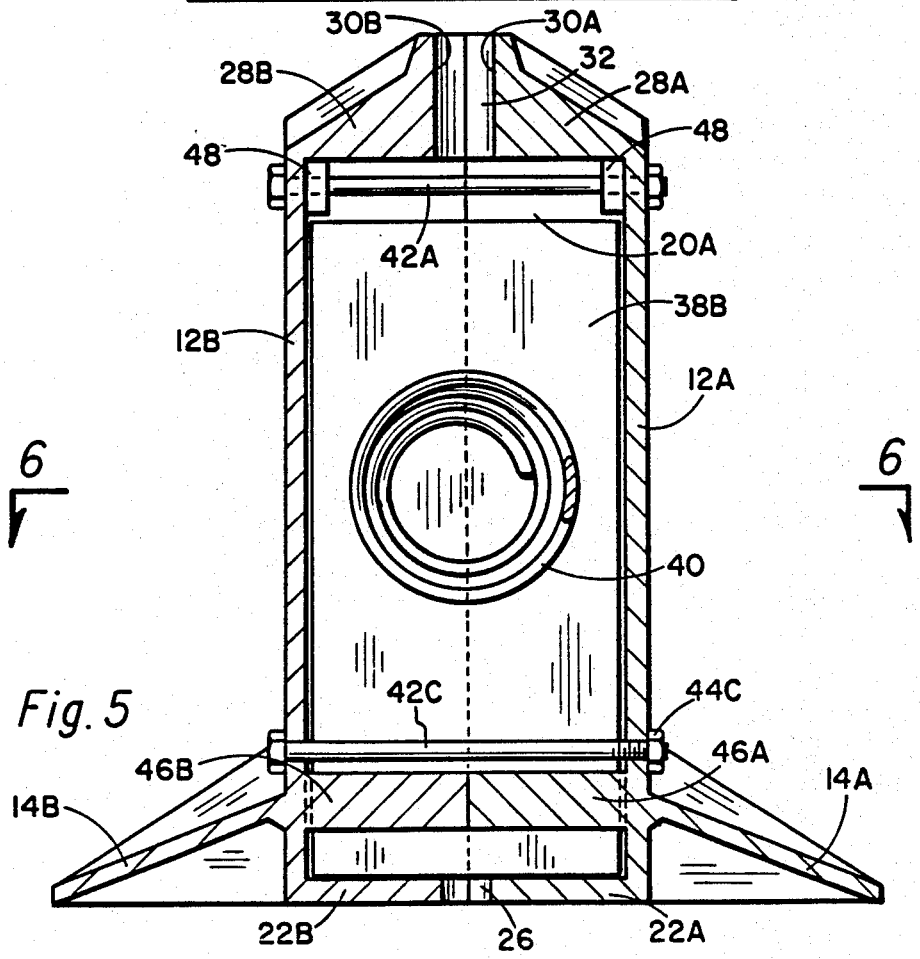
FIG. 5 is a cross-sectional view of the assembled boat anchor taken along the line 5—5 of FIG. 3.

Referring to the drawing and first to FIG. 1, the external appearance of a boat anchor which embodies the principle of this invention is shown and indicated by the numeral 10. The boat anchor includes generally a body portion 12, a flange portion 14 and a rope 16 by which the anchor is attached to a boat. More details of the construction of the anchor will now be had with reference to the exploded view of FIG. 2 and the cross-sectional FIGS. 3 through 6. The boat anchor is preferably formed of two identical body portions 12A and 12B with the body portions having flange portions 14A and 14B integrally formed therewith. The body portion 12A and 12B when assembled provide an internal cavity 18 therein and the assembled body portions form opposed internal walls 20A and 20B. The housing portions 12A and 12B have bottom portions 22A and 22B. The bottom portions each have a semi-oval recess 24A and 24B so that when the body portions are assembled an opening 26 is formed in the bottom of the housing. The function of opening 26 is to let water freely enter the interior of the housing so that air is not trapped therein. Any anchor which provides means for entrapment of air results in decreased effectiveness since the air tends to float the anchor. In the anchor of the present invention, no air can be trapped in the anchor so that the full weight thereof is useful for resisting the pull of a boat on rope 16.

Each body portion 12A and 12B also includes a top portion 28A and 28B, respectively. The top portions 28A and 28B are preferably thicker and each has a semi-circular recess 30A therein, so that the body portions when assembled provide an opening 32 in the top of the anchor. This opening serves to receive one end of rope 16. Within the cavity 18, the rope is provided with a knot 34 and a washer 36 is received on the rope and above the knot. The external diameter of the washer is greater than the internal diameter of opening 32 so that the rope is secured to the anchor.

The flange portion 14 is preferably integrally formed with the body portions 12A and 12B, the flange portion being indicated by the numerals 14A and 14B. The flange portion is, as illustrated, a frusto-pyramidal shape so that it extends outwardly and downwardly from the body portions 12A and 12B and terminates even with the housing bottoms 22A and 22B. These downwardly tapered flange portions 14A and 14B which together form the flange 14 serves to resist the drag of the anchor on the bottom surface as force is applied on rope 16 by the effect of wind or waves on the boat to which the rope is attached. In addition, this tapered flange portion 14 is configured to reduce to a minimum the possibility of the anchor being irretrievably caught under a rock, on a submerged log or in brush. When pull is exerted on the anchor with the anchor in contact with any of these items, the tapered configuration of the flange 14 will cause it to move out and away from such obstruction rather than being irretrievably caught on it. Also, the anchor will rotate or tilt toward the flange in contact with the obstruction. The flange will assume a near vertical position thus freeing the anchor from obstruction. This is accomplished by there being about two inches of leverage between the upward force or pull exerted by the anchor rope at the center of the anchor and the equal downward force exerted by the obstruction at the contact-point with the flange.

In addition, the flange 14 terminating coincident with the housing bottom serves to provide a broad base on which the anchor can be positioned in a boat when not in use and to reduce the anchor being accidently upset when the boat is in motion.

Positioned within the cavity 18 formed within the body are a plurality of weights, four of such weights 38A, 38B, 38C, and 38D being shown. As an example, each of the weights is a flat rectangular plate made of some heavy metal such as lead or stainless steel or the like which does not rust. Obviously, iron weights can be utilized but are not preferred because of the propensity of iron to rust after contact with water. The weights 38 are dimensioned to substantially fit the housing interior walls 28A and 28B and are held in engagement with the interior wall 28A and 28B by a conical shaped compression spring 40. While four of such weights are shown as an example, it can be seem that a smaller or a larger number may be employed. One of the advantages of the present invention is that the weight of the anchor can be tuned to the weight of the boat with which it is to be used so that the weight of the anchor will not exceed that which is necessary to hold the boat against the movement of wind or waves. When additional weights 38 are employed, they are inserted in parallel with the weights shown and spring 40 is compressed further to hold the weights in position. In this manner, the weights are held in position, and are not free to move around so as to prevent shifting due to normal boat action when the anchor is not in use.

A conical shaped compression spring such as of stainless steel is preferable to a straight spring. The diameter of the loop at the large end of the spring is one inch larger than the diameter of the loop at the small end. The diameter of the loop progressively gets smaller from the large end to the small end. Thus, when the spring is fully compressed each preceding loop coils inside of the succeeding loop. This allows the spring to compress to the thickness of the diameter of a single wire (used in construction of the spring) when the spring is fully compressed. This gives a great deal more flexibility to the spring which aids in the manipulation of the spring and weight-plates when the anchor has a full complement of weight-plates therein.

The anchor is preferably formed of injection molded plastic and portions 12A and 12B are formed by the same mold. The portion 12A and 12B are held together such as by means of bolts 42, there being three bolts 42A through 42C shown with nuts 44A, 44B and 44C being employed. In assemblying the anchor, the weights are placed in position in the housing portions such as housing portion 12B with the spring 40 between the weights. The rope is positioned in the groove 30B. The second housing portion 12A is inserted in position and the bolts extend through the openings provided in the housing and nuts 44 attached. The anchor is thus easily assembled or disassembled. Since both halves of the anchor are identical, only one injection mold is needed which greatly reduces the cost. Mold time in the injection mold is very short thus further reducing the cost of the anchor.

The plastic portion of the anchor can be molded in any color. Color is preferably solid throughout the plastic material. Dual colors can be achieved in the same anchor-body unit (two-toned effect) by interchanging anchor-body halves of different colors. For example, one-half of the anchor-body can be yellow and the other half can be blue, or any other combination of colors.

To add rigidity to the anchor, each of the housing portions have an integral stud portion 46 indicated as 46A and 46B. These stud portions engage each other when the housing is assembled and are directly below the openings which receive bolt 42C. The studs 46A and 46B strengthens the housing and resists the stress of bolt 42C when nut 44C is attached which would otherwise tend to deflect the sidewalls of the housing inwardly. In like manner, the housing portions have integral reinforcements 48 in the areas wherein bolts 42A and 42B are received.

The anchor of this invention is thus easily assembled utilizing two identical molded plastic portions with the required amount of weights inserted therein and with the spring 42 holding the weights in position. When the anchor is removed from service, the water therein easily and quickly drains out through hole 26 in the bottom.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A boat anchor comprising:

an enclosed housing having a cavity therein defined in part by two opposing internal walls, the housing having opposed ends;

means at one end of said housing for attachment of a flexible cable means whereby the anchor may be attached to a boat;

outwardly extending flange means at the other end of the housing;

a plurality of generally flat weight members received in said housing; and a spring means between said weight members urging them against said housing opposed internal walls.

2. A boat anchor according to claim 1 wherein said housing is formed of two substantially identical severable portions held together by bolt means.

3. A boat anchor according to claim 2 wherein said outwardly extending flange means is integrally formed as portions of each of said housing portions.

4. A boat anchor according to claim 2 wherein each of said housing portions has, at one said end thereof, a semi-circular recess therein, whereby when said housing portions are joined together an opening is formed in such end of the housing, which opening forms said means for attachment of a flexible cable means to the anchor.

5. A boat anchor according to claim 4 including:

a rope forming said flexible cable means, one end of said rope being received in said opening in the end of the housing and the rope having a knot tied therein of a size greater than said opening forming said means of attachment of said cable means to said housing.

6. A boat anchor according to claim 1 wherein said housing is elongated and is rectangular in cross-section taken perpendicular the length thereof and wherein said opposed internal walls are generally rectangular and wherein each of said generally flat weight members is generally rectangular.

7. A boat anchor according to claim 6 wherein each of said generally flat weight members is of dimensions substantially conforming to said housing internal walls.

8. A boat anchor according to claim 1 wherein said housing is elongated and is rectangular in cross-section taken perpendicular the length thereof and wherein one said end of said housing is a top end and the other a bottom end and wherein said flange means is generally truncated, open bottom, pyramidal shape with the pyramidal bottom coinciding generally with said housing bottom.

* * * * *